US005209690A

United States Patent [19]

Vriens et al.

[11] Patent Number: 5,209,690

[45] Date of Patent: May 11, 1993

[54] METHOD OF VAPOR DESPOSITING AN INTERFERENCE FILTER LAYER ON THE INSIDE OF A DISPLAY WINDOW, A DISPLAY WINDOW, A PROJECTION CATHODE RAY TUBE AND A PROJECTION TELEVISION APPARATUS

[75] Inventors: Leendert Vriens; André van der Voort; Antonius P. van de Langenberg, all of Eindhoven, Netherlands

[73] Assignee: U.S. Philips Corporation, New York, N.Y.

[21] Appl. No.: 917,731

[22] Filed: Jul. 20, 1992

Related U.S. Application Data

[63] Continuation of Ser. No. 403,542, Sep. 5, 1989, abandoned.

[30] Foreign Application Priority Data

Sep. 8, 1988 [NL] Netherlands ..... 8802210

[51] Int. Cl.[5] ..... H01J 9/22

[52] U.S. Cl. ..... 445/52; 445/58; 427/163; 427/167

[58] Field of Search ..... 427/163, 167; 445/52; 313/474

[56] References Cited

U.S. PATENT DOCUMENTS

| | | | |
|---|---|---|---|
| 4,021,850 | 5/1977 | Rogers | 313/477 |
| 4,526,802 | 7/1985 | Sato | 118/692 X |
| 4,572,984 | 2/1986 | Fitzpatrick | 313/478 |
| 4,617,490 | 10/1986 | Fitzpatrick et al. | 313/478 |
| 4,626,740 | 12/1986 | Fitzpatrick | 313/478 |
| 4,645,966 | 2/1987 | van Esdonk | 313/477 R X |
| 4,683,398 | 7/1987 | Vriens et al. | 313/474 |
| ,4899,080 | 2/1990 | Vriens et al. | 313/477 R |
| 4,904,899 | 2/1990 | Nakata et al. | 313/474 X |
| 4,933,593 | 6/1990 | Gerritsen et al. | 313/477 R X |
| 4,937,661 | 6/1990 | van der Voort | 313/474 X |

FOREIGN PATENT DOCUMENTS 0246696 11/1987 European Pat. Off. .

*Primary Examiner*—Kenneth J. Ramsey
*Attorney, Agent, or Firm*—John C. Fox

[57] ABSTRACT

Method of vapor-depositing an interference filter layer on the inside of a display window, a display window, a projection cathode ray tube and a projection television apparatus.

A method of manufacturing a projection cathode ray tube comprising an interference filter on an inwardly directed surface of a display window, the method comprising as a process step the vapor deposition of at least one layer of the interference filter. It has been found that the edges of a display window during the vapor deposition of an interference filter layer detrimentally influence the thickness of the vapor deposited layer, the thickness increases more towards the edges than follows from geometrical computations. In the method according to the invention vapor deposition is performed on a display window for which the height of the edge is less than 1/5 of the minor axis. The display screen preferably comprises a recessive edge.

14 Claims, 4 Drawing Sheets

METHOD OF VAPOR DESPOSITING AN INTERFERENCE FILTER LAYER ON THE INSIDE OF A DISPLAY WINDOW, A DISPLAY WINDOW, A PROJECTION CATHODE RAY TUBE AND A PROJECTION TELEVISION APPARATUS

This is a continuation of application Ser. No. 07/403,542, filed Sep. 5, 1989 now abandoned.

BACKGROUND OF THE INVENTION

This invention relates to a method of manufacturing a projection cathode ray tube, the method comprising the vapour deposition of a multilayer interference filter on a surface of the tubes display window, after which the display window and further components are combined to form the projection cathode ray tube in such a manner that the filter-bearing surface is on the inside of the projection cathode ray tube.

Such a method is known from European Patent Application EP 0 246 696, in which an interference filter is provided on the inside of the display window by forming a stack of vapour deposited layers of alternating high and low refractive index.

It has been found experimentally that in the method according to EP 0 246 696 using commercially available display windows for projection cathode ray tubes, the thickness of interference filter layers decreases from the centre of the display window towards the edges of the display window to a greater extent than could be expected on the basis of the relative positions of the display window and the vapour deposition source and the shape of the display window. This extra decrease in thickness of the layers is a few percent. The effect of an interference filter depends on the thickness of the layer; an extra decrease of the thickness of the layer has a detrimental influence on the effect of the interference filter.

OBJECTS AND SUMMARY OF THE INVENTION

It is an object of the invention to provide a method by which a projection cathode ray tube is obtained having a better interference filter.

For this purpose the method according to the invention is characterized in that during the vapour deposition process the said surface is surrounded by an edge having a height which is not more than 1/5 of the minimum distance between the centre of the display window and the edge.

Known display windows for projection cathode ray tubes comprise an upright edge which during the vapour deposition extends in the direction of the vapour deposition source. The height of the edge is ½ to ⅓ of the said minimum distance. It has been found experimentally that a considerable extra decrease of the thickness of the vapour deposited layers then occurs. The display window may be both substantially rectangular and circular. A projection cathode ray tube customarily comprises a rectangular display window. The minimum distance between the centre of the display window and the edge corresponds for a rectangular display window to half the length of the minor axis.

In one embodiment the height of the edge is less than 1/10 of the minimum distance between the centre of the display window and the edge.

The height preferably is at least substantially zero.

In a further embodiment the display window comprises a recessive edge.

The problem of extra decrease of the thickness of the layers towards the edge is notably great if the vapour deposition is carried out with a background gas pressure of more than $2\times10^{-4}$ mbar. The method according to the invention then notably is advantageous.

In an embodiment of the method according to the invention inter alia $TiO_2$ is vapour deposited.

The method according to the invention is notably advantageous if a short wave pass filter or a bandpass interference filter is vapour deposited.

A short wave pass filter is vapour deposited which comprises a stack of at least six layers having alternately a high and a low refractive index, each layer comprising an optical thickness between 0.2 $\lambda_f$ and 0.3 $\lambda_f$, an average optical thickness of 0.25 $\lambda$, $\lambda_f$ being equal to $p\times\lambda$ and $\lambda$ being a central wavelength selected from the emission spectrum of the display screen, and p being a number between 1.18 and 1.33.

The invention also relates to a projection cathode ray tube manufactured by the method according to the invention, and a projection colour television apparatus comprising such a projection cathode ray tube.

BRIEF DESCRIPTION OF THE DRAWINGS

A few embodiments of the method according to the invention will now be described in greater detail, by way of example, with reference to the accompanying drawing, in which:

The Figures are diagrammatic and not drawn to scale. In the various embodiments corresponding parts are generally referred to by the same reference numerals.

FIGS. 1*a* and 1*b* are a plan view and a cross-sectional view, respectively, of a display window 1 having an edge 2. On an inner surface 3, the display window 1 comprises an interference filter 4, a cathodoluminescent display screen 5 and an aluminium layer 6. The interference filter may be used, for example, to increase the useful luminous efficiency at small angles and/or to improve the colour display and/or to reduce halo. In this example, the height of the edge 2 is a and half the length of the minor axis b. FIG. 1*c* shows a similar display window having a curved inner surface.

The height of the edge is measured on the inside of the edge of the area of the minor axis. Display windows for projection cathode ray tubes are commercially available. An example of such a display window is the type Co-9054-3992 manufactured by Corning Glassworks. Such commercially available display windows have an edge having a ratio height: half minor axis of ½ to ⅓. For the type in question this ratio is 23 mm: 50.24 mm. Display windows are made by pressing molten glass, and, the edge is formed by material which is forced away from the centre of the press. For pressing a display window so much material is customarily used that a comparatively high edge is formed. This high edge also reduces the possibility of damage and increases the case of handling the display window.

Figure 1A:
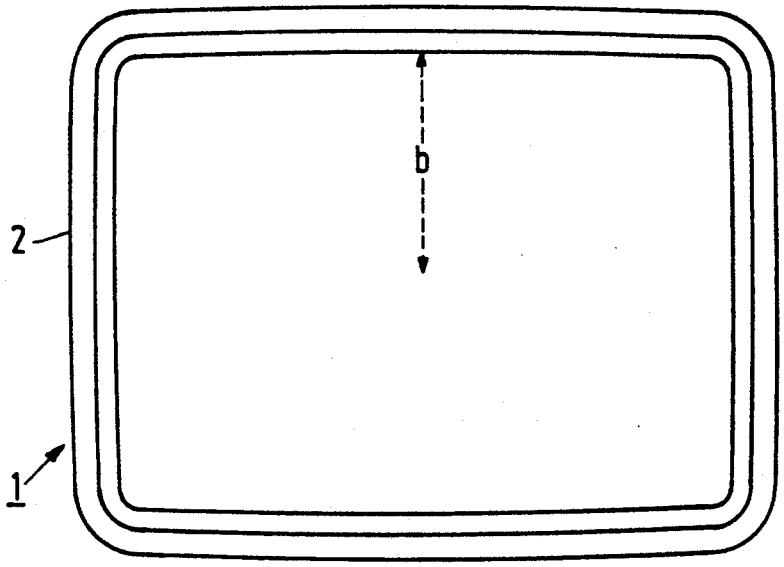
FIGS. 1*a* and 1*b* are a plan view and a cross-sectional view, respectively, of a display window having an upright edge.
Figure 1B:
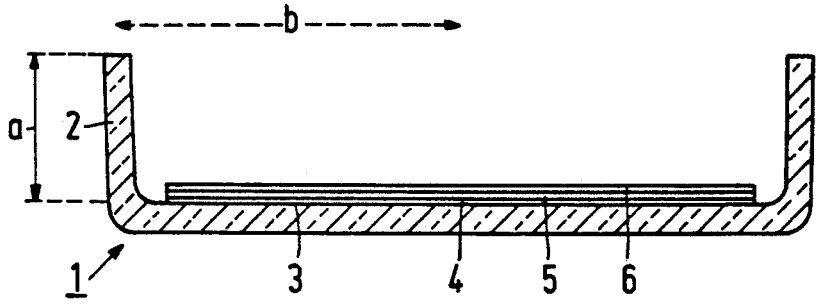
Figure 1C:
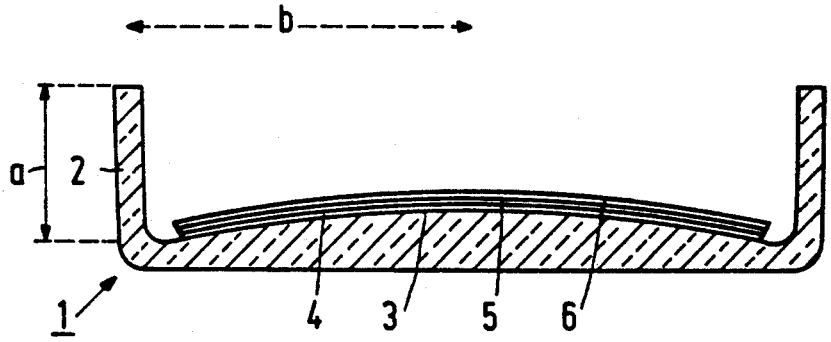
FIG. 1*c* is a cross-sectional view of a further example of a display window having an upright edge.
Figure 2:
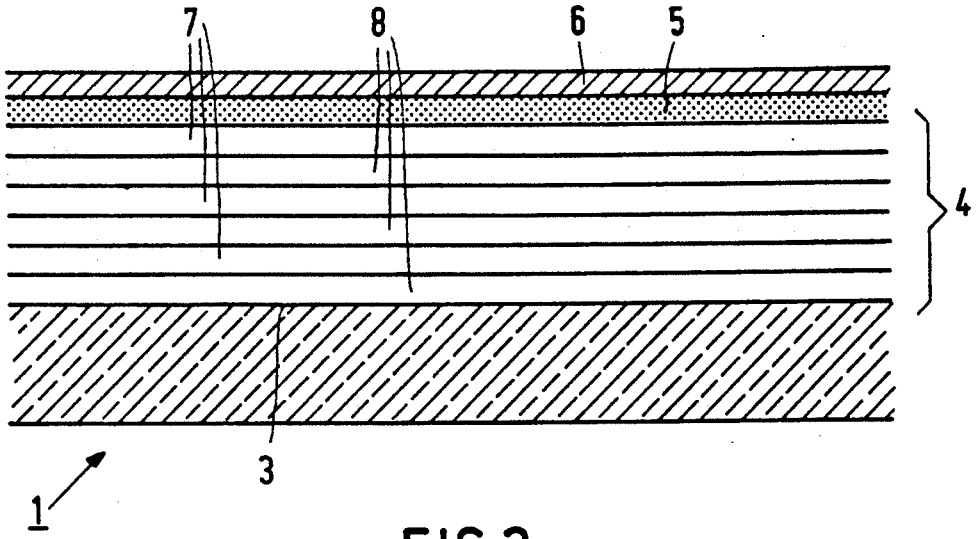
FIG. 2 is a cross-sectional view of a detail of the display window 1.

FIG. 2 is a cross-sectional view of a detail of the display window 1. The interference filter 4 is present on the inner surface 3 and comprises a stack of interference filter layers of high refractive index (8) and low refractive index (7). The interference filter 4 is present between the display screen 5 and the inner surface 3 of the display window. An aluminum layer 6 is present on the display screen 5.

Figure 3:
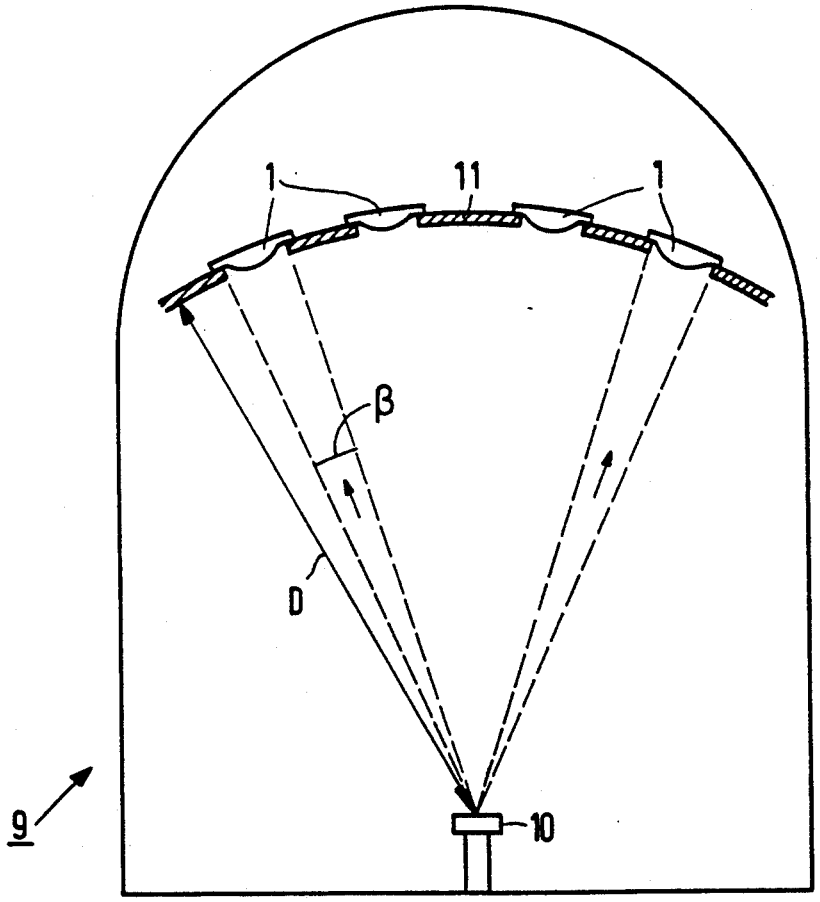
FIGS. 3 and 4 are cross-sectional views of a vapour deposition arrangement and a detail of a vapour deposition arrangement, respectively.

FIG. 3 is a cross-sectional view of a vapour deposition arrangement to illustrate the method according to the invention. This Figure is a cross-sectional view of a vapour deposition arrangement 9 having a vapour deposition source 10 and a holder 11 for display windows 1. The holder comprises apertures in which the display windows 1 are mounted. The holder generally rotates during the vapour deposition about a central axis. The vapour deposition source 10 may comprise, for example, a crucible containing a material to be vapour deposited and an element generating an electron beam, a so-called E-beam gun, for evaporating the material. The vapour deposition source 10 may comprise several crucibles. The vapour deposition arrangement may also comprise several vapour deposition sources. The material to be vapour deposited may also be heated in a different manner, for example, by means of a heating element or a laser beam or ion beam. Known materials for layers having a low refractive index are, for example, $SiO_2$ and $MgF_2$ and for layers having a high refractive index, for example, $TiO_2$, $Ta_2O_5$ and $Nb_2O_5$. These substances evaporate and are deposited on the inner surface 3 of the display window 1. The thickness of vapour-deposited interference layers on the inner surface 3 of display windows comprising an upright edge (with a/b approximately equal to 2/5) surprisingly prove not to correspond to calculations. The number of molecules (atoms) emitted towards a surface element is simple to compute:

$$N=<\beta f>t$$

wherein:

N=total number of molecules emitted towards a surface element,

<. . . >=time average of a quantity $\beta$=space angle which covers the surface element viewed from the source, f=number of molecules emitted towards the relevant surface element per solid angle per time unit, t=vapour deposition time.

The solid angle $\beta$ is directly proportional to the area A of the surface element, the cosine of the angle $\alpha$ between the normal to the surface element and the line between the surface element and the vapour deposition source and inversely proportional to the square of the distance D between the surface element and the vapour deposition source:

$$\beta=A\cos(\alpha)/D^2$$

The theoretical thickness d of a vapour-deposited layer then follows from:

$$d=N/(N_{type}A)=1/N_{type}*<f\cos(\alpha)/D^2>t$$

wherein $N_{type}$=the number of molecules per unit by volume.

Comparatively small differences may be expected in the number of molecules emitted towards a surface element of the side of the display window facing the vapour deposition source. The distance between the surface element and the vapour deposition source D and the angle between the normal to the surface element and the line between the surface element and the vapour deposition source may differ for various surface elements. On the basis of this a small decrease of the layer thickness may be expected from the centre of the display window towards the edge, approximately 0.3% along the minor axis 40 mm from the centre for display tubes having a flat inside window surface and having a minor axis of approximately 50 mm and a vapour deposition source-display window distance of approximately 85 cm; a decrease of approximately 2.0% occurs for such display tubes surface with a curved inside having a radius of curvature of 35 cm. However, it has been found that these calculations do not correspond to the experimentally measured layer thicknesses, i.e., an unexpected and important extra decrease occurs.

Figure 4:
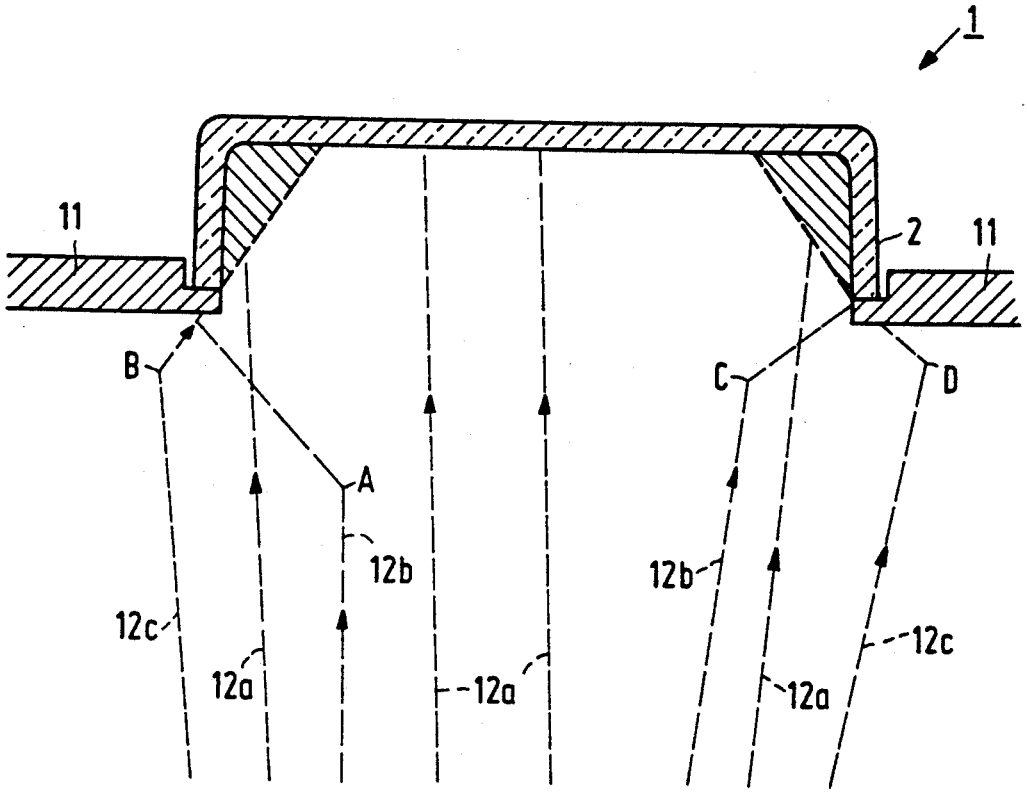

FIG. 4 shows a detail of a vapour deposition arrangement. By interactions between the emitted molecules mutually and/or between emitted molecules and background gas molecules present in the vapour deposition arrangement, some emitted molecules do not follow a straight line between the vapour deposition source and the inner surface of the display window, but experience an impact or a reaction before they reach the display window. In FIG. 4, molecules 12*b* and 12*c* experience impacts at the points A, C and B, D, respectively. It seems that such molecules, viewed from the display window, do not originate from the vapour deposition source but from a different point. The upright edge 2 at the display window 1 prevents some of these molecules to from reaching those parts of the inner surface of the display window which are situated near the edge. The edge has a shadowing effect, the "shadow" of the edge 2 is shown diagrammatically in FIG. 4 by shading. In this example, the edge 2 prevents molecules 12*c* from reaching the inner surface.

The extra decrease in thickness was particularly large if the vapour deposition was carried out at a background gas pressure of more than $2*10^{-4}$ mbar. Such pressures occur, for example, when $TiO_2$ is vapour deposited in an oxygen atmosphere. The extra decrease in thickness when $TiO_2$ was vapour deposited in an oxygen atmosphere at an oxygen pressure of $4\times10^{-4}$ mbar was at most approximately 4%. The distance between the source evaporating $Ti_2O_3$ and the display window was approximately 85 cm, the height a of the display window was 25 mm and the distance between the centre of the display window and the upright edge was 45 to 55 mm. The maximum extra decrease was measured in the corners of the display window. Along the minor axis an extra decrease of 3% was measured. The extra decrease in thickness is reduced by reducing the vapour deposition rate and the gas pressure. It has been found that this decrease does not occur entirely linearly with the background gas pressure. For a background gas pressure of $1*10^{-4}$ mbar, the extra decrease is more than ¼ of the extra decrease for a background gas pressure of $4*10^{-4}$ mbar. However, the use of a comparatively low background gas pressure extends the duration of the vapour deposition process and for $TiO_2$ it has been found in addition that the vapour deposited layer of $TiO_2$ is not sufficiently oxidised any longer so that light absorption in the $TiO_2$ layer occurs. The problem is caused not only by interactions between background gas molecules and emitted molecules but also by interactions between emitted molecules mutually. Interactions between emitted molecules mutually play a significant part if the density of the emitted molecules is large, that is to say, near the source; as the distance from the source becomes larger, interactions between emitted molecules and background gas molecules play a more important part. It has been found that the problems mentioned hereinbefore can be mitigated without the vapour deposition process lasting longer or the oxidation occurring less readily, by reducing the height of the edge. A ratio height/half minor axis of less than or approximately equal to 1:5 proved to provide good results.

A display window suitable for a projection cathode ray tube can be manufactured by reducing the height of the edge of a commercially available display window or removing the edge. An alternative is to press a display window having a low edge. Sufficient care should be taken to avoid damage.

Figure 5:
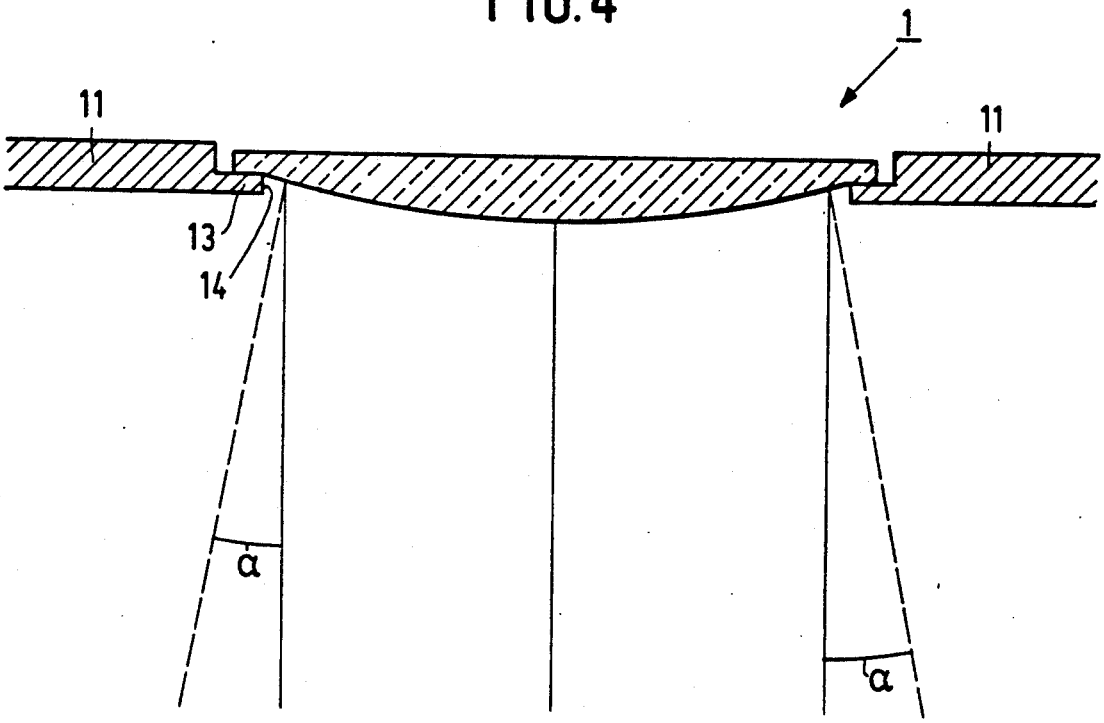
FIG. 5 shows a detail of a vapour deposition arrangement suitable for the method according to the invention.

FIG. 5 shows a detail of a vapour deposition arrangement suitable for an embodiment of the method according to the invention. Display window 1 comprises an edge 13 having a height zero. The advantage of this is that the edge 14 is not or hardly hampered by a shadowing effect. It is also shown in this Figure that the angle between the normal to the side facing the vapour deposition source, indicated by broken lines, and the direction of vapour deposition, indicated by solid lines, increases towards the edges of the display window. In certain circumstances it may be advisable to use a display window which comprises a recessive edge. A recessive edge is to be understood to mean herein an edge which is recessed in the display window. The display window may then be mounted in the holder 11 in such a manner that the edge 14 of the holder 11 does not produce any shadowing effect.

Figure 6A:
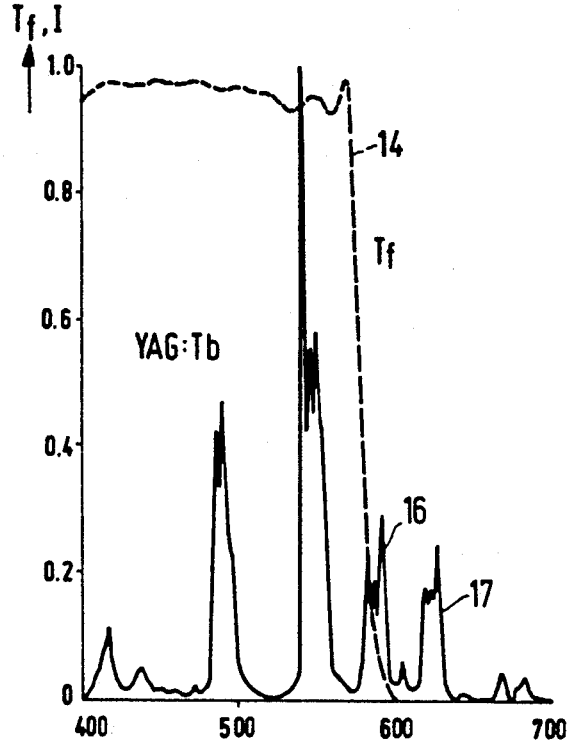
FIGS. 6*a* and 6*b* are graphs showing the effect of a variation in thickness of the layers of the interference filter.
Figure 6B:
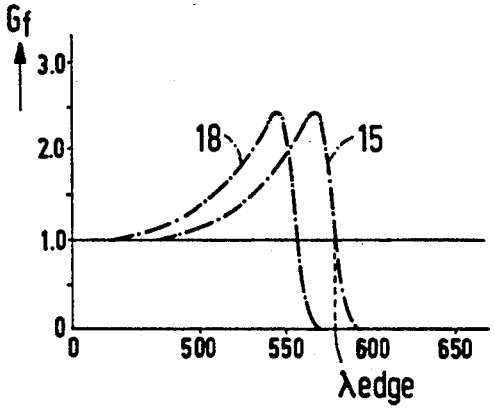

The extra thickness variation has particularly detrimental results if the interference filter is a short wave pass filter or a bandpass filter. Examples of a short wave pass filter are given in U.S. Pat. No. 4,683,398. Light having a wavelength shorter than a given wavelength $\lambda_{edge}$ is transmitted (by a short wave pass filter) or light having a wavelength $\lambda$ between wavelengths $\lambda_{edge1}$ and $\lambda_{edge2}$ is passed (for a bandpass filter). A shortwave pass filter in one embodiment comprises a stack of at least six layers having alternately a high and a low refractive index, each layer having an optical thickness between 0.2 $\lambda_f$ and 0.3 $\lambda_f$, with an average optical thickness of 0.25 $\lambda_f$, $\lambda_f$ being equal to $p\times\lambda$, and $\lambda$ being a central wavelength selected from the emission spectrum of the display window, and p being a number between 1.18 and 1.33. The position of $\lambda_{edge}$ or $\lambda_{edge2}$ with respect to the emission spectrum of the cathodoluminescent material from which the display screen is built up, is of great importance for the operation of the interference filter as shown in the graphs of FIGS. 6*a* and 6*b*. The interference filter is a filter of the type mentioned hereinbefore comprising a stack of 20 layers. Said short wave pass filter has a $\lambda_{edge}$ of approximately 580 nm. The horizontal axis indicates the wavelength $\lambda$ (in nm), the vertical axis of FIG. 6*a* gives the transmission $T_f$ in the forward direction of the interference filter (curve 14) and the emission spectrum (I) of YAG:Tb, a green phosphor. The vertical axis of FIG. 6*b* indicates the amplification $G_f$ of the light emanating in the forward direction from the display window. This amplification is a result of the fact that a part of the light emitted by the phosphor having a wavelength of approximately 550 nm is emitted at an angle with the forward direction. The effective optical wavelength of the layers of the interference filter has been increased for such light, since they traverse the layers obliquely. Such light is reflected towards the display screen by the interference filter, a part of the reflected layer is then scattered back in the forward direction so that more light emanates in the forward direction. This amplification is shown by curve 15 in FIG. 6*b*. This amplification shows a maximum for a wavelength near $\lambda_{edge}$. A number of the spectral lines emitted by the phosphor are filtered away by the interference filter, in this example two lines 16 and 17 around 600 nm, the spectral lines around 550 nm are amplified, the spectral line around 490 nm is neither filtered away nor amplified. The position of $\lambda_{edge}$ is chosen to be such that the overall luminous efficiency increases, and chromaticity of the emitted light satisfies the EBU standard. Curve 18 in FIG. 6*b* shows the amplification of the light emanating in the forward direction from the display window for an interference filter the thickness of each layer of which is reduced by 4%. The interference filter now has $\lambda_{edge}=555$ nm, the amplification of the light of the spectral lines around 550 nm depends to a great extent on the position of $\lambda_{edge}$, relative variations of $\lambda_{edge}$ resulting in large variations in intensity and chromaticity of the emitted light. This is a problem in particular in a three colour projection television arrangement. The intensity and chromaticity of the picture for each of the three cathode ray tubes will vary as a result of which colour differences between the picture displayed in the centre of the display window and in the edges of the display window will occur.

It has been found that for a rectangular display window having a long half axis of approximately 62.5 mm, a minor half axis b of approximately 50 mm and a height of the edge a of approximately 25 mm, a distance between the display window and the vapour deposition source of 85 cm and a background gas pressure of $4*10^{-4}$ mbar at a point on the long axis 40 mm from the centre, the $TiO_2$ layers of the filter were 3% thinner than calculated; in a corner of the display window, 4% thinner. It has been found that at a ratio a/b smaller than 1/5, the extra thickness variation of the interference filter layers is less than approximately 1.5%, which led to a significantly improved picture display. Preferably, the edge is even lower, is entirely absent or the display window comprises a recessed edge. The invention is of particular advantage if the display window is curved on its inside. For a display window having a curved profile, a center-to-edge decrease of the thickness of the layers occurs already during the vapour deposition as a result of geometrical factors. With the given vapour deposition arrangement, for example, the thickness variation, as a result of geometrical factors only, for a display window, the inner surface of which has a radius of curvature of 35 cm, amounts to approximately 1.8% for the minor axis, to 2.0% for the long axis.

Figure 7:
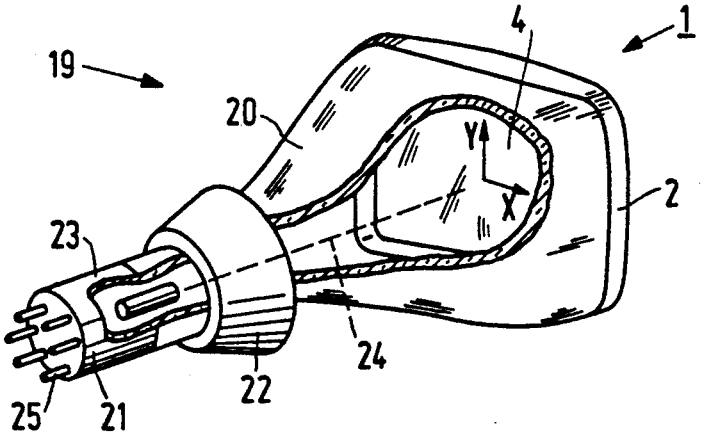
FIG. 7 is a perspective view, partly broken away, of a projection cathode ray tube manufactured according to the method of the invention.

FIG. 7 is a perspective view partly broken away of a projection cathode ray tube manufactured according to the method of the invention. Projection cathode ray tube 19 comprises a display window 1 having an edge 2 provided on its inside with an interference filter 4. Projection cathode ray tube 19 further comprises a cone 20 and a neck 21, which together with display window 1 constitutes an evacuated envelope. Projection cathode ray tube 19 also comprises a deflection unit 22 and an electron gun 23 for emitting an electron beam 24, and external pin connections 25. The projection cathode ray tube, for example, may also be a flat cathode ray tube. A projection television apparatus comprises three projection cathode ray tubes the emitted green, red and blue light, respectively, which are combined to form one image on a projection screen.

It will be obvious to those skilled in the art that many variations are possible without departing from the scope of this invention.

We claim:

1. A method of manufacturing a projection cathode ray tube comprising a display window, the method comprising vapour depositing a multilayer interference filter on an inside surface of the display window, characterized by surrounding the display window with an edge having a height above the inside surface which is from about 1/10 to about 1/5 of the minimum distance between the centre and the edge of the display window.

2. A method as claimed in claim 1, characterized in that the side of the display window facing the vapour deposition source is curved.

3. A method as claimed in claim 1, characterized in that vapour deposition is carried out with a background gas pressure of more than $2*10^{-4}$ mbar.

4. A method as claimed in claim 1, characterized in that $TiO_2$ is vapour deposited.

5. A method as claimed in claim 1, characterized in that a short wave pass interference filter is vapour deposited.

6. A method as claimed in claim 5, characterized in that a short wave pass filter is vapour-deposited which comprises a stack of at least six layers having alternately a high and a low refractive index, each layer having an optical thickness between 0.2 $\lambda_f$ and 0.3 $\lambda_f$, an average optical thickness of 0.25 $\lambda_f$, $\lambda_f$ being equal to $p\times\lambda$ and $\lambda$ being a central wavelength selected from the emission spectrum of the display screen, p being a number between 1.18 and 1.33.

7. A method as claimed in claim 1, characterized in that a bandpass interference filter is vapour deposited.

8. A method of manufacturing a projection cathode ray tube comprising a display window, the method comprising vapour depositing a multilayer interference filter on an inside surface of the display window, characterized in that the display window comprises a recessive edge.

9. A method as claimed in claim 8, characterized in that the side of the display window facing the vapour deposition source is curved.

10. A method as claimed in claim 8, characterized in that vapour deposition is carried out with a background gas pressure of more than $2*10^{-4}$ mbar.

11. A method as claimed in claim 8, characterized in that $TiO_2$ is vapour deposited.

12. A method as claimed in claim 8, characterized in that a bandpass interference filter is vapour deposited.

13. A method as claimed in claim 8, characterized in that a short wave pass interference filter is vapour deposited.

14. A method as claimed in claim 13, characterized in that a short wave pass filter is vapour-deposited which comprises a stack of at least six layers having alternately a high and low refractive index, each layer having an optical thickness between 0.2 $\lambda_f$ and 0.3 $\lambda_f$, an average optical thickness of 0.25 $\lambda_f$, $\lambda_f$ being equal to $p\times\lambda$ and $\lambda$ being a central wavelength selected from the emission spectrum of the display screen, p being a number between 1.18 and 1.33.

* * * * *